United States Patent [19]

Hellsten et al.

[11] 4,430,238

[45] Feb. 7, 1984

[54] ESTERIFIED DICARBOXYLIC ACID AND ITS USE

[75] Inventors: Karl M. E. Hellsten, Ödsmal; Anders W. Klingberg, Henan, both of Sweden

[73] Assignee: Berol Kemi AB, Stenungsund, Sweden

[21] Appl. No.: 376,338

[22] Filed: May 10, 1982

[30] Foreign Application Priority Data

May 18, 1981 [SE] Sweden ..... 8103099

[51] Int. Cl.[3] ..... B03D 3/00; C22B 3/00

[52] U.S. Cl. ..... 252/61; 252/351

[58] Field of Search ..... 252/61, 351

[56] References Cited

U.S. PATENT DOCUMENTS 2,302,338 11/1942 Moeller et al. ..... 252/61

2,759,607 8/1956 Boyd et al. ..... 252/61

3,779,380 12/1973 Bishop ..... 252/61

*Primary Examiner*—John E. Kittle

*Assistant Examiner*—Robert A. Wax

[57] ABSTRACT

The present invention specifies an esterified dicarboxylic acid of the general formula $$R^{I}\underset{\underset{O}{\|}}{C}OA\underset{\underset{O}{\|}}{C}R^{II}\underset{\underset{O}{\|}}{C}OH$$

in which $R^{I}$ is an aliphatic hydrocarbon group with 7–21 carbon atoms, $R^{II}$ is a hydrocarbon radical with 2–6 carbon atoms and A is an alkylene oxide group derived from an alkylene oxide with 2–4 carbon atoms. Particularly preferred are compounds in which A relates to a group derived from ethylene oxide and in which $R^{II}$ is —CH=CH— or the phenylene group —$C_6H_4$—. The compound exhibits selective properties when used in the flotation of oxide and salt type minerals.

7 Claims, No Drawings

ESTERIFIED DICARBOXYLIC ACID AND ITS USE

The present invention relates to a new esterified dicarboxylic acid, which exhibits selective properties in the flotation of oxide and salt type minerals, for instance apatite.

Compounds have already been disclosed in Swedish Patent Publication 417 477 and U.S. Pat. No. 2,099,120 which have the general formula $$R^{I}(OC_2H_4)_nO\underset{\underset{O}{\|}}{C}R^{II}\underset{\underset{O}{\|}}{C}OH$$

in which $R^{I}$ is an alkyl group with 8–18 carbon atoms, $R^{II}$ is a hydrocarbon radical with 2–6 carbon atoms and n is a number between 0 and 10. These compounds are suitable for use as a collector reagent in conjunction with the flotation of minerals such as apatite and fluorspar. These compounds cause large quantities of froth to form, however, which requires flotation to take place in the presence of an active anti-foaming additive such as fuel oil.

It has now been found that another type of esterified dicarboxylic acid is not only a selective collector reagent for oxide minerals, but also produces only moderate quantities of froth. Accordingly, this type of compound may be used as a flotation reagent either in conjunction with small quantities of anti-foaming additives or, in certain cases, in the absence of any such additives.

Compounds in accordance with the present invention have the general formula $$R^{I}\underset{\underset{O}{\|}}{C}OA\underset{\underset{O}{\|}}{C}R^{II}\underset{\underset{O}{\|}}{C}OH \qquad \text{I}$$

in which $R^{I}$ is an aliphatic hydrocarbon group with 7–21 carbon atoms, $R^{II}$ is a hydrocarbon radical with 2–6 carbon atoms and A is an oxyalkylene group derived from an alkylene oxide with 2–4 carbon atoms. Particularly preferred are compounds in which A denotes a group derived from ethylene oxide and in which $R^{II}$ is —CH=CH— or the phenylene group $—C_6H_4—$.

The nature of the esterified dicarboxylic acids in accordance with the present invention is such that the group $$R^{I}\overset{\overset{O}{\|}}{C}—$$

is derived from carboxylic acids such as 2-ethylhexanoic acid, caprylic acid, capric acid, lauric acid, myristic acid, palmitic acid, stearic acid, oleic acid, ricinoleic acid, linoleic acid, linolenic acid, abietic acid and dehydroabietic acid. Particularly preferred are the unsaturated carboxylic acids. $R^{II}$ is preferably derived from a dicarboxylic acid such as oxalic acid, succinic acid, glutaric acid, adipic acid, maleic acid, citraconic acid, terephthalic acid and phthalic acid.

Compounds in accordance with the present invention may be prepared by the addition of alkylene oxide to one mol of a carboxylic acid of the formula $$R^{I}COOH \qquad \text{II}$$

in which $R^{I}$ is as described above, so as to produce the monoester $$R^{I}\overset{\overset{O}{\|}}{C}OAH.$$

This reaction is preferably carried out in the presence of a molar deficiency of the alkylene oxide. The reaction has been described in greater detail by M. Bares et al in an article entitled 'Reactions of fatty acids and their derivates with ethylene oxide, II: Kinetics of the reaction of stearic acid with ethylene oxide' published in Tenside Detergents 12 (1975) No. 3 pp 162–167. If so desired non-esterified carboxylic acid and/or any ethylene glycol which has formed and/or any diester which has formed may be separated from the reaction mixture before the monoester is reacted with a dicarboxylic acid anhydride of the formula $$O{=}C{-}R^{II}{-}C{=}O \quad (\text{cyclic, O bridging the two C}) \qquad \text{III}$$

in which $R^{II}$ is as described above, in equivalent quantities or in slight excess over the monoester if this has not previously been isolated. The conversion with dicarboxylic acid anhydride (III) may suitably be carried out at a temperature of approximately 60°–115° C. The compound in accordance with the present invention is usually obtained in a total yield of approximately 80% of the monocarboxylic acid originally added.

As has already been indicated, the diester in accordance with the present invention has the ability to selectively enrich oxide minerals, such as apatite, during the froth flotation process. This property may be further reinforced by the presence of a hydrophobic secondary collector reagent in the form of a polar, water-insoluble substance with an affinity for the mineral particles coated by the esterified dicarboxylic acid. Esterified dicarboxylic acid in accordance with the present invention is usually added at a level of between 10 and 1,500, but preferably 50–800, grams per ton of ore, and the polar, water-soluble substance at a level of between 0 and 1,000 grams, but preferably 5–750 grams, per ton of ore. In the event of both the esterified dicarboxylic acid and the hydrophobic substance being used, their relative proportion may vary within wide limits, but will usually lie within the range 1:10–20:1, and will preferably lie within the range 1:5–5:1.

The polar, water-insoluble secondary collector reagent in accordance with the present invention is preferably in the form of an alkylene oxide adduct of the general formula $$R^{III}(A)_{p1}OH \qquad \text{IV}$$

in which $R^{III}$ denotes a hydrocarbon group, preferably an aliphatic group, or an alkylaryl group with 8–22 carbon atoms, A denotes an oxyalkylene group derived from an alkylene oxide with 2–4 carbon atoms and $p_1$ is a number between 1 and 6; or it may be in the form of an ester compound of the general formula $$R^{IV}\underset{\underset{O}{\|}}{C}O(A)_{p2}Y \qquad \text{V}$$

in which $R^{IV}$ denotes a hydrocarbon group with 7–21 carbon atoms, A denotes an alkylenoxy group derived from an alkylene oxide with 2–4 carbon atoms, $p_2$ denotes a number between 0 and 6 and Y denotes an alkyl group with 1–4 carbon atoms or hydrogen.

In addition to their advantageous flotation effect, these preferred secondary collector reagents also have a favourable effect on foaming, since they produce a foam of acceptable stability in combination with the esterified dicarboxylic acid in accordance with the present invention.

When applying the procedure in accordance with the present invention, it is also possible to add in a manner known per se pH-regulating substances, such as sodium carbonate and sodium hydroxide, as well as depressants and activating agents. In the majority of flotation processes separation is influenced by the pH-value of the pulp. The flotation process in accordance with the present invention is also dependent on the pH value, which should be above 7 for the majority of ores, and preferably within a pH range of 8–11. Previously disclosed foaming agents and depressants and activating agents may also be added, if so desired.

The esterified dicarboxylic acid in accordance with the present invention and its use are illustrated in greater detail by the following examples.

EXAMPLE 1

280 g (1.0 mol) of tall oil fatty acid was allowed to react with 39.6 g (0.9 mol) of ethylene oxide in the presence of 1.68 g of potassium hydroxide as a catalyst at a temperature of 120° C. for 3 hours. The resulting product, which is a clear, yellow-brown liquid of low viscosity, contained 80% by weight of mono-tall oil fatty acid ethylene glycol ester. Other components were di-tall oil fatty acid ethylene glycol ester, fatty acid soap, ethylene glycol and unreacted fatty acid. 27 g (0.28 mol) of maleic anhydride were then added to 100 g of the reaction mixture obtained by the above method. The temperature was raised to 80° C., and the entire mixture was allowed to react for 1 hour. The resulting reaction mixture, which was a clear liquid of low viscosity, contained 84% by weight of a compound $$RCOCH_2CH_2O\overset{O}{\overset{\|}{C}}CHCHCOOH$$

in which $$R\overset{O}{\overset{\|}{C}}-$$

is an acyl group from the tall oil fatty acid.

EXAMPLE 2

41 g (0.28 mol) of phthalic anhydride was added to 100 g of the reaction mixture of the first reaction step obtained in Example 1 and which contained mono-tall oil fatty acid ethylene glycol ester. The temperature was raised to 120° C. and the entire mixture was allowed to react 1 hour. The resulting reaction mixture, which was a slightly turbid liquid, contained 85% by weight of the compound $$RCOCH_2CH_2O\overset{O}{\overset{\|}{C}}C_6H_4COOH$$

in which $$R\overset{O}{\overset{\|}{C}}-$$

is an acyl group from the tall oil fatty acid. The total yield based on tall oil fatty acid was 75%.

EXAMPLES 3–4

Apatite-containing tailing from a benefication plant was found to contain 41% by weight of apatite, 6% by weight of calcite, 10% by weight of iron minerals (principally hematite), remainder silicates. Approximately 80% of this material passed through a 98 μm screen. A mineral pulp was prepared by mixing 1 kg of the apatite-containing tailing with 1.5 liters of water, after which the pulp was transferred to a 2-liter flotation cell. 0.5 g of 38% sodium silicate (mol proportion $Na_2O:SiO_2$ 1:33) were added to the pulp after which the whole was allowed to condition for 5 minutes. A 1% aqueous solution was prepared from a compound in accordance with Example 1 and was neutralized with sodium carbonate until a pH value of about 9 was reached, after which in Example 3 30 ml of the solution were added to the pulp as a collector reagent, and in Example 4 24 ml of the solution were added together with 0.6 g of fuel oil to Swedish Standard No. 4.

For the purpose of a comparison, A, a 1% solution of the following compound $$C_{12-14}H_{25-29}O(CH_2CH_2O)_3\overset{O}{\overset{\|}{C}}CHCHCOOH$$

was prepared, this being a preferred compound in accordance with Swedish Patent Publication 417 477. The compound was neutralized with sodium carbonate, of which a quantity of 30 ml was added to the pulp produced from the apatite-containing tailing instead of the collector reagent above.

For the purpose of a comparison, B, a secondary collector reagent consisting of 0.6 g of fuel oil to Swedish Standard No. 4 was added in addition to the 22.7 ml of the collector reagent added for comparison A.

After the addition of the collector reagent and, where appropriate, of the secondary collector reagent, the pulp was allowed to condition for a further 5 minutes. It was then subjected to a rougher flotation process. The rougher concentrate was then cleaned 5 times by flotation at a temperature of 20±1° C. The pH-value of the pulp decreased from approximately 9.5 to approximately 8.5 during the flotation operations. The following results were obtained

| | FINAL CONCENTRATE | |
|---|---|---|
| TEST | ASSAY P, % by weight | YIELD of P % |
| 3 | 17.0 | 89.0 |
| 4 | 17.0 | 74.5 |
| A | 15.3 | 71.8 |
| B | 14.5 | 39.5 |

It may be seen from the results that the collector reagent in accordance with the present invention produced significantly better results than the collector reagent in accordance with Swedish Patent Publication 417 477.

EXAMPLE 5

Flotation of the apatite-containing tailing was performed by the same method as described in Example 4, but with the difference that the fuel oil was replaced by a surface-active, non-ionic, water-insoluble compound with the formula

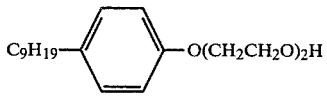

To serve as a reference a test C was performed in accordance with comparison B, but with the difference that the fuel oil was replaced by the aforementioned surface-active, non-ionic, water-insoluble compound. The following results were obtained.

| | FINAL CONCENTRATE | |
|---|---|---|
| TEST | ASSAY P, % by weight | YIELD of P % |
| 5 | 16.8 | 92.5 |
| C | 15.9 | 66.7 |

EXAMPLE 6

Flotation was performed by the same method described in Example 4, but with the difference that also added to the pulp were 30 ml of a solution containing 0.9% of a compound in accordance with Example 2 and 0.1% of a compound of the formula

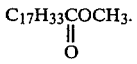

After the flotation process cleaning the rougher concentrate 5 times by flotation, the concentrate obtained was found to contain 16.4% by weight of phosphorus. The phosphorus yield was 87.2%.

EXAMPLE 7

Flotation was performed by the same method described in Example 3, but with the difference that the compound in accordance with Example 1 was replaced by the compound in accordance with Example 2.

To serve as a reference, test D was performed in accordance with the comparative test A, but with the difference that the partially esterified maleic acid was replaced by a compound with the formula

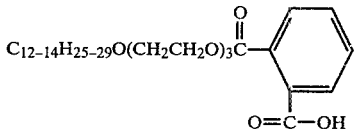

which is covered by Swedish Patent Publication 417 477. The following results were obtained

| | FINAL CONCENTRATE | |
|---|---|---|
| TEST | Assay P, % by weight | Yield of P % |
| 7 | 16.7 | 87.3 |
| D | 15.3 | 84.1 |

We claim:

1. A process for the froth flotation of oxide minerals and salt minerals which comprises carrying out the froth flotation in the presence as a collector reagent of an esterified dicarboxylic acid having the general formula

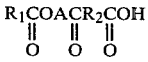

in which $R_1$ is aliphatic hydrocarbon having from seven to twenty-one carbon atoms, $R_2$ is hydrocarbon having from two to six carbon atoms and A is oxyalkylene having from two to four carbon atoms.

2. A process according to claim 1 in which A is oxyethylene.

3. A process according to claim 1 in which $R_2$ is —CH=CH— or phenylene $—C_6H_4—$.

4. A process according to claim 1 in which the esterified dicarboxylic acid is used in conjunction with a water-insoluble polar secondary collector reagent.

5. A process according to claim 4 in which the water-insoluble polar secondary collector reagent is an alkylene oxide adduct having the formula:

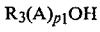

in which $R_3$ is hydrocarbon having from eight to twenty two carbon atoms, A is oxyalkylene derived from an alkylene oxide having from two to four carbon atoms and $p_1$ is a number from 1 to 6.

6. A process according to claim 5 in which $R_3$ is aliphatic or alkylaryl.

7. A process according to claim 4 in which the polar secondary collector reagent is an ester having the formula:

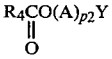

in which $R_4$ is hydrocarbon having from seven to twenty one carbon atoms, A is oxyalkylene derived from an alkylene oxide having from two to four carbon atoms, $p_2$ is a number from 0 to 6, and Y is alkyl having from one to four carbon atoms or hydrogen.

* * * * *